US006273187B1

(12) United States Patent
Voisin, Jr. et al.

(10) Patent No.: US 6,273,187 B1
(45) Date of Patent: Aug. 14, 2001

(54) METHOD AND APPARATUS FOR DOWNHOLE SAFETY VALVE REMEDIATION

(75) Inventors: Clayton J. Voisin, Jr., Raceland; Edward Chittenden, Houma, both of LA (US); Christopher M. Michel, Kingwood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/390,716

(22) Filed: Sep. 7, 1999

Related U.S. Application Data

(60) Provisional application No. 60/099,827, filed on Sep. 10, 1998.

(51) Int. Cl.[7] ..... E21B 29/00; E21B 43/115; E21B 34/00; E21B 37/00

(52) U.S. Cl. ..... 166/63; 166/297; 166/311; 166/376

(58) Field of Search ..... 166/55, 63, 65.1, 166/297, 299, 311, 376

(56) References Cited

U.S. PATENT DOCUMENTS

| | | | |
|---|---|---|---|
| 3,721,297 | 3/1973 | Challacombe . | |
| 4,161,219 | 7/1979 | Pringle . | |
| 4,436,155 | 3/1984 | Brieger . | |
| 4,515,217 | 5/1985 | Stout . | |
| 4,557,331 | 12/1985 | Stout . | |
| 4,572,288 | 2/1986 | Kinley . | |
| 4,757,863 | 7/1988 | Challacombe . | |
| 4,869,171 | 9/1989 | Abouav . | |
| 4,971,160 | 11/1990 | Upchurch . | |
| 5,188,183 | 2/1993 | Hopmann et al. . | |
| 5,318,126 * | 6/1994 | Edwards et al. | 166/297 |
| 5,369,579 | 11/1994 | Anderson . | |
| 5,571,968 | 11/1996 | Snider et al. . | |
| 5,595,243 | 1/1997 | Maki, Jr. et al. . | |
| 5,680,905 * | 10/1997 | Green et al. | 175/4.54 |
| 5,826,661 | 10/1998 | Parker et al. . | |

FOREIGN PATENT DOCUMENTS

WO 00/15945 3/2000 (WO) .

OTHER PUBLICATIONS

Micro–Smart Systems, Inc., World Wide Web Page at http://www.micro–smart.com/Bc–100.html, printed on Jul. 31, 2000, two pages, Dated Jul. 1998.

* cited by examiner

*Primary Examiner*—David Bagnell
*Assistant Examiner*—Jennifer R. Dougherty
(74) *Attorney, Agent, or Firm*—Goldstein & Healey LLP

(57) ABSTRACT

In a broad aspect, the invention relates to a method and apparatus for downhole safety valve remediation using a measured, controlled, explosion to remove scale and/or other debris from within or around the downhole safety valve or for explosively locking out the safety valve in an open position.

14 Claims, 3 Drawing Sheets

Fig. 1
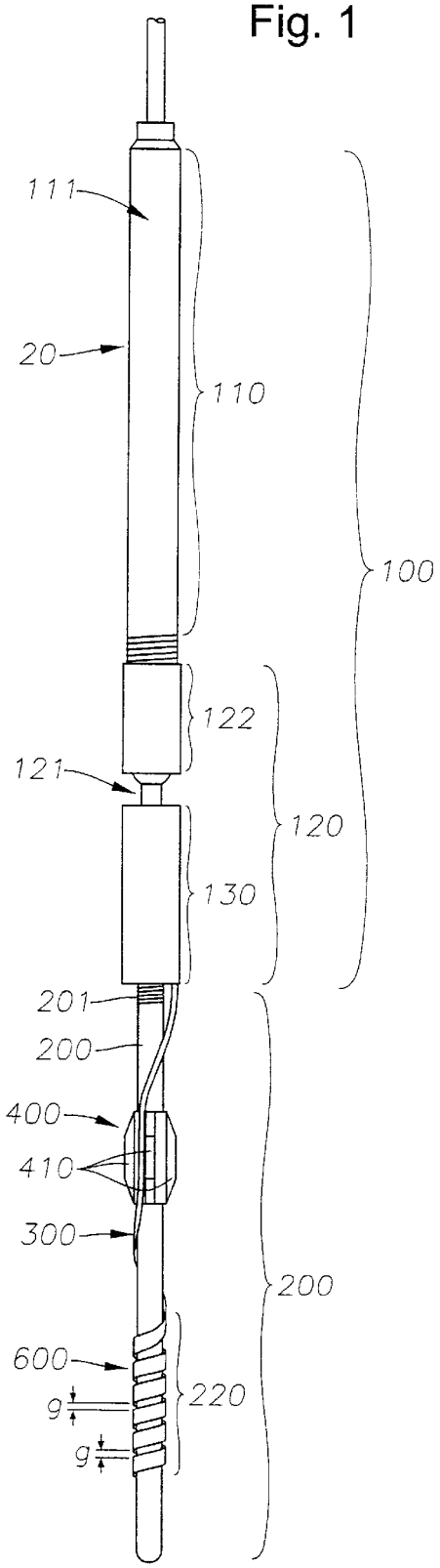
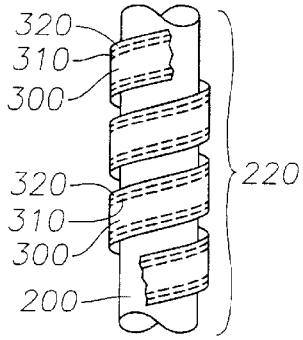
Fig. 1A
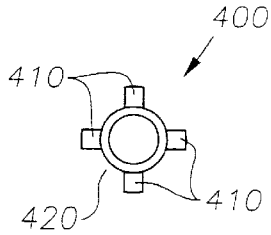
Fig. 1D
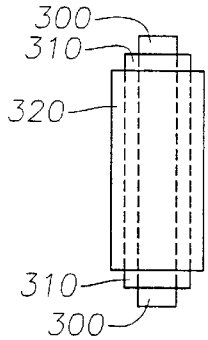
Fig. 1B
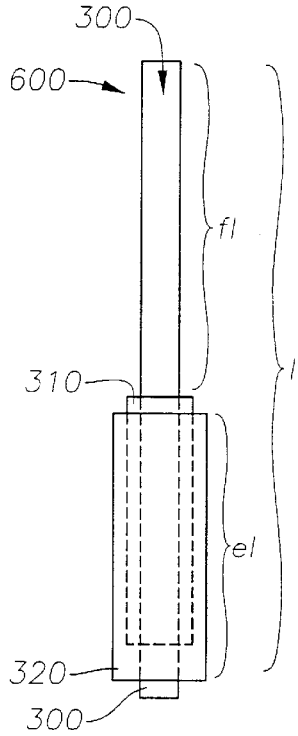
Fig. 1C

METHOD AND APPARATUS FOR DOWNHOLE SAFETY VALVE REMEDIATION

RELATED APPLICATIONS

This application claims the benefit of U.S. Provisional Application No. 60/099,827, filed Sep. 10, 1998.

BACKGROUND OF THE INVENTION

1. Field of the Invention

The present invention relates generally to a method and apparatus for downhole safety valve remediation using controlled detonation of a measured explosive charge.

2. Description of the Related Art

Subsurface safety valves are commonly used in wells to prevent uncontrolled fluid flow through the well in the event of an emergency, such as to prevent a well blowout. Conventional safety valves use a flapper, which is biased by a spring to a normally closed position, but is retained in an open position by the application of hydraulic fluid operating on a rod piston connected to the flapper valve from the earth's surface. A typical surface controlled subsurface safety valve ("SCSSV") is shown and described in U.S. Pat. No. 4,161,219, which is commonly assigned hereto.

Through normal operation of a well, scale and other debris can build up on the inner surface of the well tubing. In addition to the well tubing surface build-up, however, scale, asphaltines, and other debris can also build up within the bore of the safety valve as well as on the mechanical parts of the safety valve, themselves, to render the safety valve either more difficult to operate or even totally inoperative. Various methods and apparatus have been employed to remediate safety valves after such a scale or debris build-up. For example, coiled tubing has been used in connection with an orifice nozzle to remove the scale or debris build-up with fluid pressure. Further, a running tool may be used to remediate the valve. The running tool may have a tool profile adapted to mate with a well profile associated with the desired valve. When the tool reaches the desired location within the well, the tool may then be engaged within the well profile and mechanical force is applied to the tool, jerking the tool back and forth in hopes of freeing the valve from the binding force of the scale or other debris build-up. As an additional example, in the event the valve is stuck in the closed, or sealing, position a simple rod may be lowered into the well to the desired location within the safety valve and mechanical force is applied to mechanically beat downward on the flapper or other sealing member within the valve body in hopes that the mechanical force will overcome the binding force of the scale or other debris build-up within the valve.

There are other safety valve failures or problems that may arise that require safety valve remediation in a typical well operation. For example, a typical safety valve, as described above, may be maintained in its open position by maintaining hydraulic pressure through a hydraulic control line within the well casing extending from the safety valve to a source of hydraulic pressure at the well surface. In the event of, for example, a hydraulic pressure leak in the hydraulic control line or a hydraulic pump failure, hydraulic pressure may not be maintained to the safety valve. In such a situation, it may not be possible to maintain the safety valve in its fully open position in which case production fluid may be partially or completely restricted through the safety valve. It may not be possible or desirable to remove the safety valve in such a situation; therefore, various methods and apparatus have been employed to remediate safety valves in such a situation. Typically, a wireline inset valve may be inserted into the safety valve to lock out the valve to maintain the valve in its open position and permit production fluid to continue to flow through the valve. However, such methods and apparatus may be expensive and may not be desirable in a particular application.

Explosive charges have been employed in certain well operations, particularly in certain downhole electric line well operations. Previously, explosive charges have been used, for example, to: perforate well casing and any surrounding formation to permit fluid flow into the well casing from the formation; set and release packers for sealing off between the well casing and production tubing extending through the casing; and break up scale or other debris build-up from, for example, threaded tools or tubing joints to facilitate removing the tools or tubing string from the well. However, explosive forces have not heretofore been incorporated in a method or apparatus for remediation of downhole safety valves. In the case of scale and other debris build-up removal, it has not heretofore been possible or practical to effectively control the explosive forces within the safety valve body to remove the scale or other debris build-up while preventing undesirable destruction or damage to the safety valve or to lockout a defective safety valve while preventing or minimizing damage to proximate tubing or other apparatus within the well.

The prior methods and apparatus have not previously provided an adequate remediation solution for safety valves. Accordingly, there has developed a need to provide a method and apparatus for downhole safety valve remediation using precisely controlled explosive forces to remove scale and other debris build-up or to lockout a defective safety valve. The present invention has been contemplated to meet this need.

SUMMARY OF THE INVENTION

In a broad aspect, the invention is a downhole safety valve remediation method using detonation of an explosive charge to break up scale, asphaltics, and/or other debris build-up from within and around the safety valve. In another aspect, the invention is a downhole safety valve remediation apparatus having a means for pre-determining certain well conditions that must exist before permitting detonation of an explosive charge so that the charge may be precisely located before detonation, which is used to break up the scale, asphaltics, and/or other debris build-up from within and around the safety valve.

In another aspect, the invention is a downhole safety valve remediation method using detonation of an explosive charge to lock out the safety valve so that hydraulic pressure is not required to maintain the safety valve in its open position. In another aspect, the invention is a downhole safety valve remediation apparatus having a means for predetermining certain well conditions that must exist before permitting detonation of an explosive charge so that the charge may be precisely located before detonation, which is used to lock out the safety valve so that hydraulic pressure is not required to maintain the safety valve in its open position.

In another aspect, the invention is a downhole safety valve remediation apparatus, comprising: a location means for locating a desired position within a well associated with the safety valve for detonation of an explosive charge proximate thereto, the charge being pre-selected to achieve a desired level of concussive force within the safety valve to effect remediation thereof.

In another aspect, the invention is a downhole safety valve remediation apparatus, comprising: a firing control unit; a lengthwise member connected to and extending generally away from the firing control unit; a length of primer cord operatively connected to the firing control unit and having an explosive length thereof wrapped around the lengthwise member; and a length of friction tape wrapped around the lengthwise member along the explosive length of primer cord. The firing control unit may further comprises a firing head and a detonator; and the firing head may include: a battery section housing a battery; a memory and control section, operatively connected to the battery for storing pre-selected fining parameters and for selectively controlling the flow of current between the battery and the detonator; and a monitoring section, operatively connected to the memory section for monitoring well conditions related to the pre-selected firing parameters. Further, the memory and control section may control current flow in response to the well conditions, and the memory and control section may provide current flow between the battery and the detonator when the well conditions monitored by the monitoring section are within the pre-selected firing parameters stored in the memory and control section. Still further, the firing head may further include a voltage step-up section provided between the battery section and the detonator for increasing the voltage provided between the battery and the detonator, whereby the voltage may be increased to a value of approximately 186 volts in certain preferred embodiments.

In still another aspect, the invention is a method for remediation of downhole safety valves, comprising the steps of: providing a downhole tool having an explosive charge connected thereto; lowering at least a portion of the downhole tool into a well to a position proximate the downhole safety valve to be remediated; and detonating the explosive charge. The explosive charge may be detonated using a firing control unit, which may comprise a firing head and a detonator. The firing head may include: a battery section housing a battery; a memory and control section, operatively connected to the battery for storing pre-selected firing parameters and for selectively controlling the flow of current between the battery and the detonator; and a monitoring section, operatively connected to the memory section for monitoring well conditions related to the pre-selected firing parameters. Further, the firing control unit may be located on the wireline tool proximate the explosive charge and the firing control unit may be remotely located from the explosive charge or located proximate the well surface.

BRIEF DESCRIPTION OF THE DRAWINGS

FIG. 1 is an elevational side view, showing a downhole safety valve remediation apparatus of the present invention.

FIG. 1A is a partial elevational side view of the shot rod of the present invention wrapped with an explosive length of primer cord with lengths of common electrical tape and friction tape also wrapped co-extensively therearound.

FIG. 1B is a partial elevational view of an explosive length of primer cord, showing layers of common electrical tape and friction tape disposed thereon, respectively.

FIG. 1C is an elevational view of a length of primer cord, including a fuse length and an explosive length having layers of common electrical tape and friction tape disposed thereon, respectively.

FIG. 1D is a cross-sectional view taken along section A—A of FIG. 1, showing the cross- sectional configuration of the flow-through orienting sleeve of the present invention.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 2:
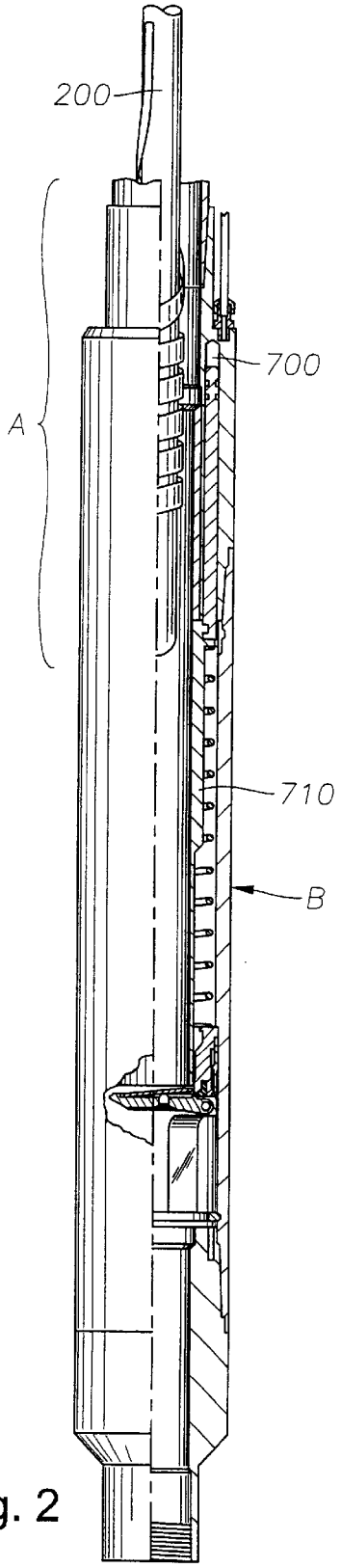
FIG. 2 is an elevational side view, partially in cross-section, showing the explosive portion of the remediation apparatus of the present invention lowered into a desired position within a safety valve to be remediated.

Referring to FIG. 1, a downhole safety valve remediation apparatus of the present invention is shown. The downhole safety valve remediation apparatus preferably includes a location means 20, or locators, for locating a desired position A within a well. The desired position A may be associated with a safety valve B (FIG. 2), and (as shown in FIG. 2) is preferably a position proximate to or within the interior of the safety valve B, itself. Using the method and apparatus of the present invention, the position within or otherwise associated with the safety valve may be selected with a relatively high degree of accuracy for detonation of an explosive charge proximate thereto. In addition to the selection of the position of the charge within or otherwise associated with the safety valve B prior to detonation, the charge itself may be pre-selected to achieve a precise, measured, and desired level of concussive force within the safety valve B to effect remediation thereof. Various types and intensities of charges may be selected depending on the particular form of safety valve remediation desired.

In one embodiment, the location means 20 may be of the variety commercially known as Micro-Smart SMART Blaster available from Micro-Smart System, Inc., Houston, Tex. 77053 and as disclosed and described in U.S. Pat. No. 5,369,579 to Anderson, the disclosure of which is incorporated by reference as though set forth fully herein. However, many other location means 20, or locators, may be used. In a particular embodiment, as shown in FIG. 1, the apparatus of the present invention may comprise a firing control unit 100; a lengthwise member 200, or shot rod, connected to and extending generally away from the firing control unit 100; a length of primer cord 300 operatively connected to the firing control unit 100 and having an explosive length el (FIG. 1C) thereof wrapped around an explosive portion 220 of the lengthwise member 200; and a length of friction tape 320 wrapped around the lengthwise member 200 along the explosive length el of primer cord 300. In addition, it may be desirable to provide a length of common electrical tape 310 between the primer cord 300 and the friction tape 320 (see FIGS. 1A–1C).

Figure 3:
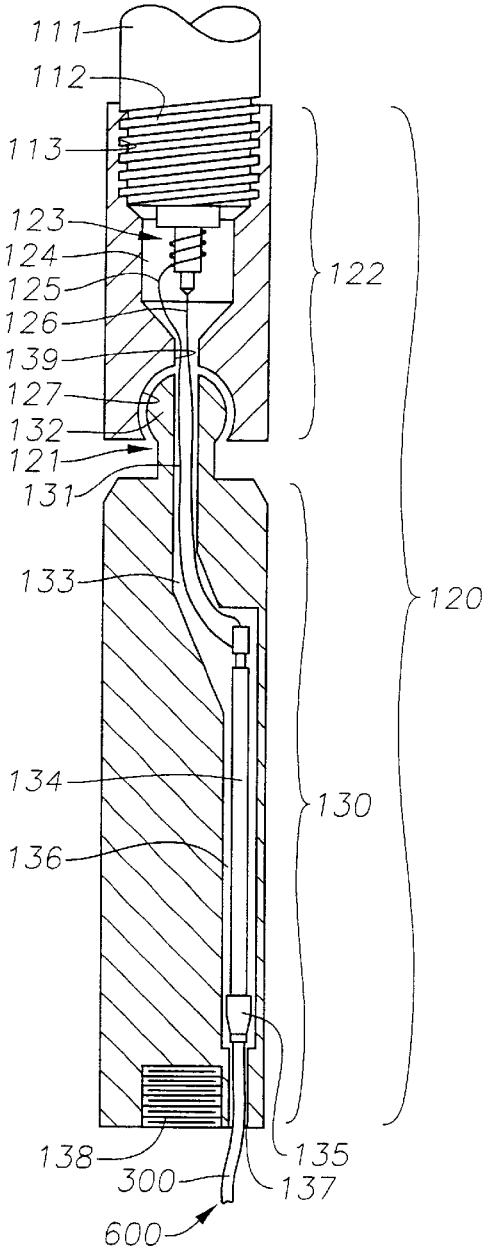
FIG. 3 is a cross-sectional side view of a detonator section of the remediation apparatus of the present invention.
Figure 4:
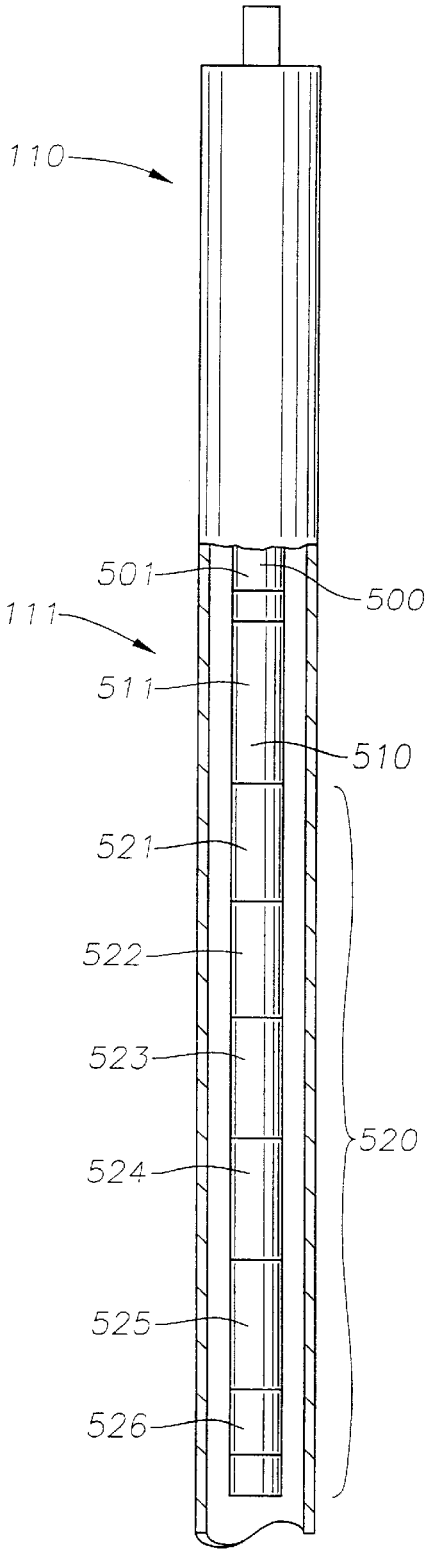
FIG. 4 is a partial elevational side view of the firing head section of the remediation apparatus of the present invention.
Figure 5:
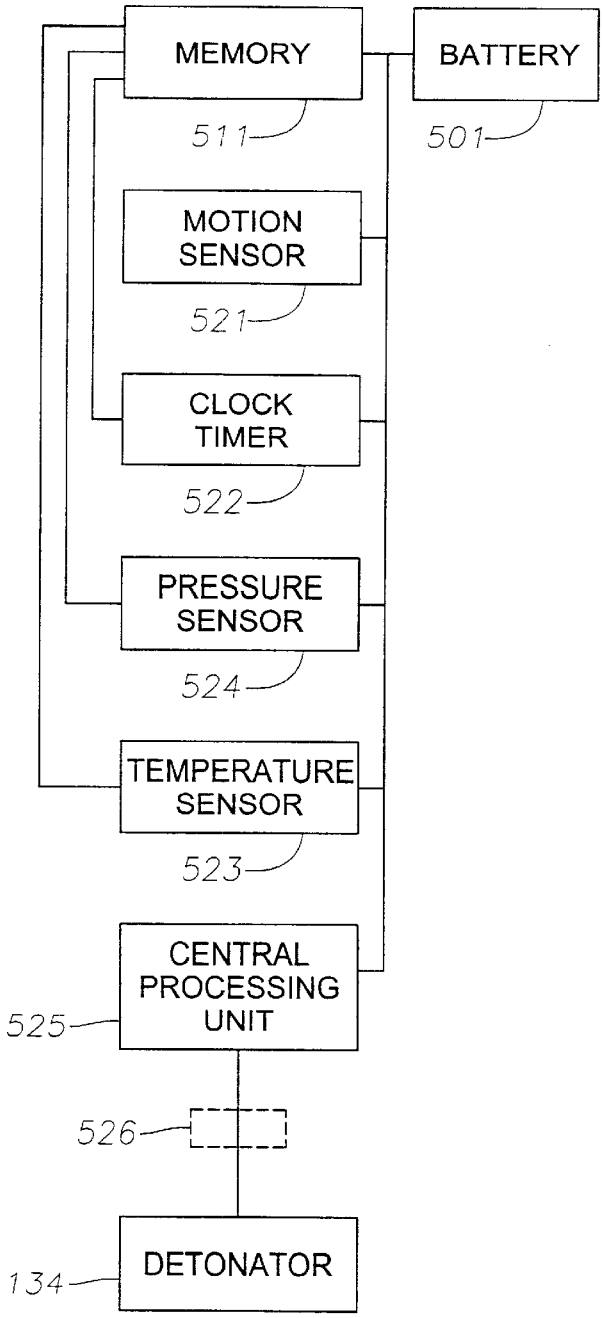
FIG. 5 is a schematic diagram of the interoparability of various components of the remediation apparatus of the present invention.

Preferably, with reference to FIGS. 1 and 3, the firing control unit 100 further comprises a firing head 111 and a detonator 134, which may be located in a firing head section 110 and a detonator section 120, respectively. Referring now to FIG. 4, the firing head 111 may preferably include: a battery section 500; a memory and control section 510; and a monitoring section 520. In a particular embodiment, the battery section 500 may house or otherwise contain a battery 501, which preferably may be a 5 cell lithium battery rated for temperatures up to 325°.

Preferably, the memory and control section 510 is operatively connected to both the battery 501 and the detonator 134 (FIG. 3) and includes a solid state non-volatile electronic memory 511 for acquiring and storing multiple sets of downhole data before, during, and after explosive detonation. The stored data may be retrieved after detonation by use of a computer after recovery of the remediation apparatus from the well bore for subsequent computer analysis. The memory and control section 510 may further include an electronic control circuit operatively connected to the electronic memory 511 and the monitoring section 520 described hereafter for providing electrical current from the battery 501 to the detonator 134 (FIG. 3) in response to the parameters stored in the electronic memory 511.

The monitoring section 520 may include a variety of parameter measurement devices 521, 522, 523. For example, in a particular embodiment a motion sensor 521 may be provided for measuring motion of the remediation apparatus within the well bore. A clock timer 522 may also be provided for measuring elapsed time between certain measured events such as cessation and resumption of motion of the remediation apparatus. A temperature sensor 523 may further be provided to measure the well bore temperature proximate the remediation apparatus. A static pressure transducer 524 may also be provided to measure the static pressure within the well bore proximate the remediation apparatus. In addition, other desired parameters may be measured using appropriate sensors known in the art.

The memory and control section 510 preferably provides current to the detonator 134 when the measured parameters fit within the pre-selected range of parameters stored in the electronic memory 511 by use of a central processing unit ("CPU") 525 or fire control 525, which receives and processes electronic logic signals being continuously received from the motion sensor 521, clock timer 522, pressure sensor 524, temperature sensor 523, or other parameter measurement devices. The CPU 525 generates an electronic detonation signal permitting electrical initiation of the detonator 134 by the electrical energy of the battery 501 only when the signal output of these sensors 521, 523, 524 and the clock timer 522 collectively provide the CPU 525 with firing logic signals which establish approval for the downhole detonation. If a logic signal from either of these control modules 521–524 is in the non-firing mode, the CPU 525 will not output a firing signal to the detonator 134.

In a particular embodiment, a voltage step-up device 526 may be provided in connection with the firing head 111 between the battery section 500 and the detonator 134 to step up, or increase, the voltage between the battery 501 and the detonator 134. By way of illustration only, in a particular embodiment, the voltage may be increased from about 13 volts to about 186 volts, which may improve the effectiveness or efficiency of the detonator 134. The step up device 526 may be a resistorized device module 526, which may include an arrangement of resistors to step up the voltage selectively applied to the detonator 134.

Referring now to FIG. 3, in a particular embodiment the detonator 134 may be provided in a detonation chamber 136 of detonator section 130, and may receive electrical current from the firing head 111 to initiate detonation. In a preferred embodiment, the detonator 134 is a resistor, which preferably is rated at 51 ohms. A suitable detonator 134 may be of the type generally available from Ensign-Bickford as Model No. EP105. The detonator 134 is operably connected to an explosive charge 600, which in a preferred embodiment may be a length l of primer cord 300 in electrical contact with the detonator 134 by use of a crimp 135 or other standard fastener known in the art. With reference to FIG. 1C, in such an embodiment, the length l of primer cord 300 may comprise a fuse length fl and an explosive length el. As shown in FIG. 3, electrical current from the firing head 111 may be provided to detonator 134 through a coupling 121, which in a particular embodiment may be a specially adapted knuckle joint 121, through which an electrical conduit 131 is provided. Firing head 111 may include a threaded fastener portion 112 for threadable engagement within a threaded fastener portion 113 of connecting section 122 adapted to receive firing head 111. Firing head 111 may include a coaxial electronic connector 123 from which a first and a second electrical conductor 125 and 126, respectively, may extend within a sealed chamber 124 before passing through electrical conduit 131 provided in the specially adapted knuckle joint 121. The knuckle joint 121 may comprise a socket portion 127 associated with the connecting section 122, having an electrical conduit 139 formed therethrough and ball portion 132 associated with detonator section 130, having the electrical conduit 131 formed therethrough.

The electrical conductors 125 and 126 extend from the coaxial connector 123, through the chamber 124, through the electrical conduits 131, 139 formed in the ball and socket portions 132, 127, respectively, through the electrical conduit 133 formed in the detonator section 130, and into the detonation chamber 136 formed in the detonator section 130, and finally connect to electrical contacts associated with the detonator 134. The coupling 121 permits the detonator section 130 and the shot rod 200 to move with respect to the firing head 111 upon detonation and firing of the charge 600. Electrical current passed to the detonator 134 causes the detonator 134 to heat up, thereby igniting a section of the primer cord 300. With reference to FIG. 1C, the fuse length fl of the primer cord 300 then burns as a fuse to the explosive length el of the primer cord 300, as will be described in greater detail hereinbelow.

Referring now to FIG. 1, the shot rod 200, or other lengthwise member 200, may be operatively connected to the detonator section 120, in the embodiment shown having a separate detonator section 120, or is otherwise connected to the firing head 111 of the present invention. The fuse length fl of primer cord 300 may extend from the detonator 134 to a desired charge location 220 on the shot rod or lengthwise member 200. The charge 600 used may comprise an explosive length el of primer cord 300, which, as shown at the bottom of FIG. 1, in a particular embodiment may be spirally wrapped about the circumference of the lengthwise member 200 proximate the charge location 220. Premeasured gaps g may be provided between successive wraps, or windings, depending on the particular explosive characteristics desired. The type of primer cord 300 used, the explosive length el of the primer cord 300, and the gap width g between successive wraps, or windings, thereof may be selected to achieve a predicted and controlled concussive force in the vicinity of the charge 600. The explosive length el of the primer cord 300 may be distinguished from the fuse length fl primarily in that the explosive length el may be wrapped with a length of common electrical tape 310 and/or a length of friction tape 320 (see, e.g., FIG. 1C), which will cause the primer cord 300 to explode with a concussive force rather than burn as a fuse.

By way of illustration only, in a preferred embodiment for locking out a defective safety valve, an approximately 70 inch length l of 80 grain/ft primer cord 300 may be wrapped along an approximately ½ inch diameter shot rod 200 having a length of approximately 5 ft. The primer cord 300 may be wrapped along an approximately thirty-inch explosive length of the shot rod 200 having a gap width g of approximately one inch. The explosive length el of primer cord 300 is then co-extensively wrapped with a length of common electrical tape 310 and a length of friction tape 320.

Referring now to FIG. 2, the shot rod 200 is then lowered, preferably attached to the firing control unit 100 to a desired location A within an upper and lower boundary of a hydraulic chamber 700 of the safety valve B but not in a flow tube 710 in the safety valve B. Electrical detonation of the fuse length fl of primer cord 300, which separates the detonator 134 from the explosive length el of primer cord 300, is then provided to cause the fuse length fl of the primer cord 300 to burn as a fuse to the explosive length el of the primer cord 300, at which point the explosive length el of the primer cord 300 explodes to create a concussive force proximate the charge 600 proximate to or within the hydraulic chamber 700 of the safety valve B. The concussive force may then cause the safety valve B to expand in diameter, thereby rendering the safety valve B inoperable, preferably locking it in the open position.

By way of another illustration only, in a preferred embodiment for removing scale or other debris build-up within the safety valve B, an approximately 70 inch length l of 40 grain/ft primer cord 300 may be wrapped along an approximately ½ inch diameter shot rod 200 having a length of approximately 5 ft. The primer cord 300 may be wrapped along an approximately thirty-inch explosive length el of the shot rod 200 having a gap width g of approximately one inch. The explosive length el of the primer cord 300 is then co-extensively wrapped with a length of common electrical tape 310 and a length of friction tape 320.

The shot rod 200 is then lowered, preferably attached to the firing control unit 100 to a desired location A proximate to and preferably within an upper and lower boundary of the hydraulic chamber 700 of the safety valve B but not in the flow tube 710. Electrical detonation of the fuse length fl of primer cord 300 is then provided to cause the fuse length fl of the primer cord 300 to burn as a fuse to the explosive length el of primer cord 300, at which point the explosive length el of primer cord 300 explodes to create a concussive force proximate the charge 600 within the hydraulic chamber 700 of the safety valve B.

Referring to FIGS. 1 and 1D, a flow-thru orienting sleeve 400 may be provided and disposed around the shot rod 200 to assist in lowering the apparatus of the present invention to the desired location A (FIG. 2) within the well. The flow-thru orienting sleeve 400 may include a plurality of flanges 410, which extend outwardly to increase the effective outer diameter of the shot rod 200 to minimize undesirable contact of the shot rod 200 with components within the well bore. A space 420 is provided between the flanges 410 to permit fluids to pass through the orienting sleeve 400 and along shot rod 200 as the apparatus of the present invention is lowered into place and then removed. The concussive force may then cause the scale or other debris build-up to be dislodged from within the safety valve B.

As will be readily perceived by one skilled in the art, various selections and combinations of explosive length, grain density, gap widths, and other criteria may be made to achieve varying degrees of remediation. Further, repeated application of the explosive forces may be required to remediate certain safety valves. For example, excessive scale or other debris build-up may be present. In such a circumstance, repeated low-level explosive charges may be used to loosen the build-up without damaging the safety valve. It should also be noted that, in a particular embodiment, other forms of detonation and types of charges may also be used to achieve the particular result desired.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A downhole safety valve remediation apparatus, comprising:

a locator adapted to locate a desired position within a well associated with the safety valve to facilitate detonation of an explosive charge proximate thereto, the charge being pre-selected to achieve a desired level of concussive force within the safety valve to effect remediation thereof.

2. A downhole safety valve remediation apparatus, comprising: a firing control unit;

a lengthwise member connected to and extending generally away from the firing control unit;

a length of primer cord operatively connected to the firing control unit and having an explosive length thereof wrapped around the lengthwise member; and a length of friction tape wrapped around the lengthwise member along the explosive length of primer cord.

3. The downhole safety valve remediation apparatus of claim 2, wherein the firing control unit further comprises a firing head and a detonator.

4. The downhole safety valve remediation apparatus of claim 3, wherein the firing head includes:

a battery section housing a battery;

a memory and control section, operatively connected to the battery for storing pre-selected firing parameters and for selectively controlling the flow of current between the battery and the detonator; and a monitoring section, operatively connected to the memory section for monitoring well conditions related to the pre-selected firing parameters.

5. The downhole safety valve remediation apparatus of claim 4, wherein the memory and control section controls current flow in response to the well conditions.

6. The downhole safety valve remediation apparatus of claim 4, wherein the memory and control section provides current flow between the battery and the detonator when the well conditions monitored by the monitoring section are within the pre-selected firing parameters stored in the memory and control section.

7. The downhole safety valve remediation apparatus of claim 6, wherein the firing head further includes a voltage step-up section provided between the battery section and the detonator for increasing the voltage provided between the battery and the detonator.

8. The downhole safety valve remediation apparatus of claim 7, wherein the voltage is increased to a value of approximately 186 volts.

9. A method for remediation of downhole safety valves, comprising:

providing a downhole tool having an explosive charge connected thereto;

lowering at least a portion of the downhole tool into a well to a position proximate a downhole safety valve to be remediated; and detonating the explosive charge.

10. The method of claim 9, wherein the explosive charge is detonated using a firing control unit having a firing head and a detonator, the firing head including:

a battery section housing a battery;

a memory and control section, operatively connected to the battery for storing pre-selected firing parameters and for selectively controlling the flow of current between the battery and the detonator; and a monitoring section, operatively connected to the memory section for monitoring well conditions related to the pre-selected firing parameters.

11. The method of claim 10, wherein the firing control unit is located on the downhole tool proximate the explosive charge.

12. The method of claim 10 wherein the firing control unit is remotely located from the explosive charge.

13. The method of claim 12, wherein the firing control unit is located proximate the earth's surface.

14. A downhole safety valve remediation apparatus, comprising:

a locator adapted to locate a desired position within a well associated with the safety valve for of an explosive charge proximate thereto, the charge being preselected to achieve a desired level of concussive force within the safety valve to effect remediation thereof.

* * * * *